US005232388A

United States Patent [19]

Danjell

[11] Patent Number: 5,232,388

[45] Date of Patent: Aug. 3, 1993

[54] "GLOW" SIGNAGE AND METHOD FOR MANUFACTURING SAME

[76] Inventor: Barbara Danjell, 24 East St., Columbus, Ohio 43228

[21] Appl. No.: 958,269

[22] Filed: Oct. 8, 1992

[51] Int. Cl.[5] ..... G09F 13/08

[52] U.S. Cl. ..... 445/22; 156/67; 40/540; 40/543

[58] Field of Search ..... 445/22; 156/67; 40/540, 40/543; 250/458.1

[56] References Cited

U.S. PATENT DOCUMENTS 2,375,177 5/1945 Reese ..... 156/67

4,711,044 12/1987 Danjell ..... 40/540

4,767,477 8/1988 Danjell ..... 156/67

5,162,160 11/1992 Matsui et al. ..... 156/67

*Primary Examiner*—Mark Rosenbaum

*Assistant Examiner*—Jeffrey T. Knapp

*Attorney, Agent, or Firm*—Porter, Wright, Morris & Arthur

[57] ABSTRACT

Signage and a method of making a sign which produces the visual effect of a pleasant "glow" to an observer whereby the brilliance of a back-lighted design image subtly fades out from a uniformly illuminated central image to a diffusion.

22 Claims, 2 Drawing Sheets

"GLOW" SIGNAGE AND METHOD FOR MANUFACTURING SAME

FIELD OF THE INVENTION

This invention relates to signage and to a method of making a sign which produces the visual effect of a pleasant "glow" to an observer whereby the brilliance of a back lighted design image subtly fades from a uniformly illuminated central image to a diffuse edge.

BACKGROUND OF THE PRIOR ART

Graphic and back-lighted illuminated displays are well known, and self-illuminating graphic displays using neon tubes are popular.

My prior U.S. Pat. Nos. 4,711,044 and No. 4,767,477 discuss the disadvantages of back-lighted displays and neon tubes in the prior art and disclose a novel method and sign which produces "neon look" lighting.

Since the invention of my prior Letters Patent, I have developed improved signage which expands the range of uses and sizes appropriate for "neon" type glow displays and images and I have also developed new methods which facilitate the manufacture thereof.

OBJECTS OF THE INVENTION

It is an object of the invention to provide an enhanced signage product which produces, in an extended image, a pleasant and colorful aurora, glow or halo effect around the image. It is a further object to provide an efficient method by which such signage may be manufactured. And it is yet a further object to provide line type signage having a glow effect in line widths appreciably broader than the widths associated with conventional neon tubes.

These and other objects will be evident when considered in view of the following description of the preferred embodiment taken in conjunction with the drawings in which:

DESCRIPTION OF THE PREFERRED EMBODIMENT

Figure 1:
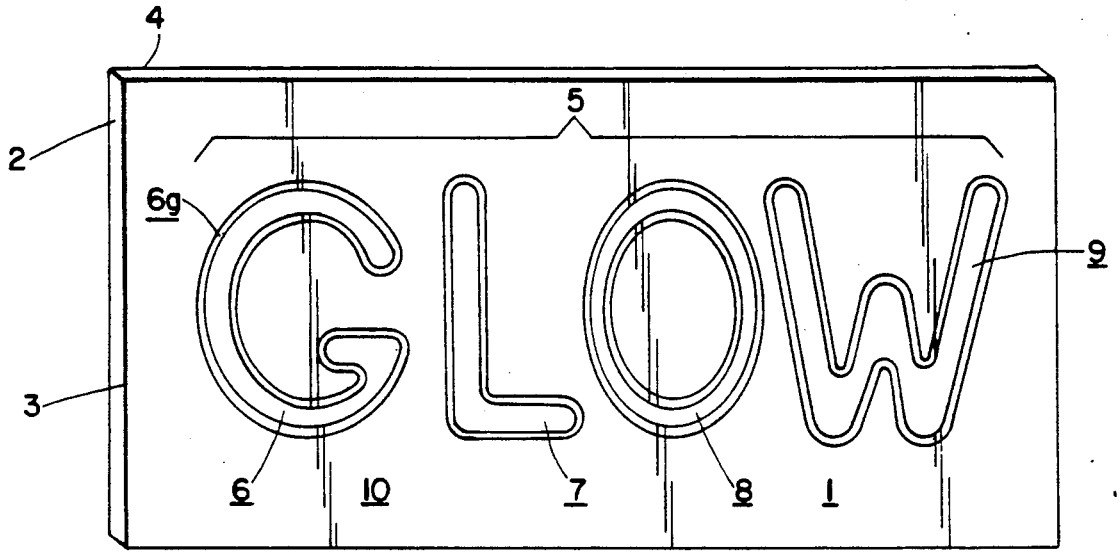
FIG. 1 shows a front view of a sign panel in accordance with the invention.

In the sign panel shown at FIG. 1 a substrate panel 2 having front 3 and reverse 4 surfaces is shown having a display image 5 of the invention formed of component letter images "G" 6, "L" 7, "O" 8 and "W" 9. In signs, the image to be displayed 5 is typically provided in a color which contrasts with a background color 10, for example, green on black, red on blue, etc. The image to be displayed may be informational, aesthetic, utilitarian and can be of a suitable size and shape appropriate to the message and environment. The signs of the invention are particularly appealling for retail, food service and supermarket displays.

Figure 2:
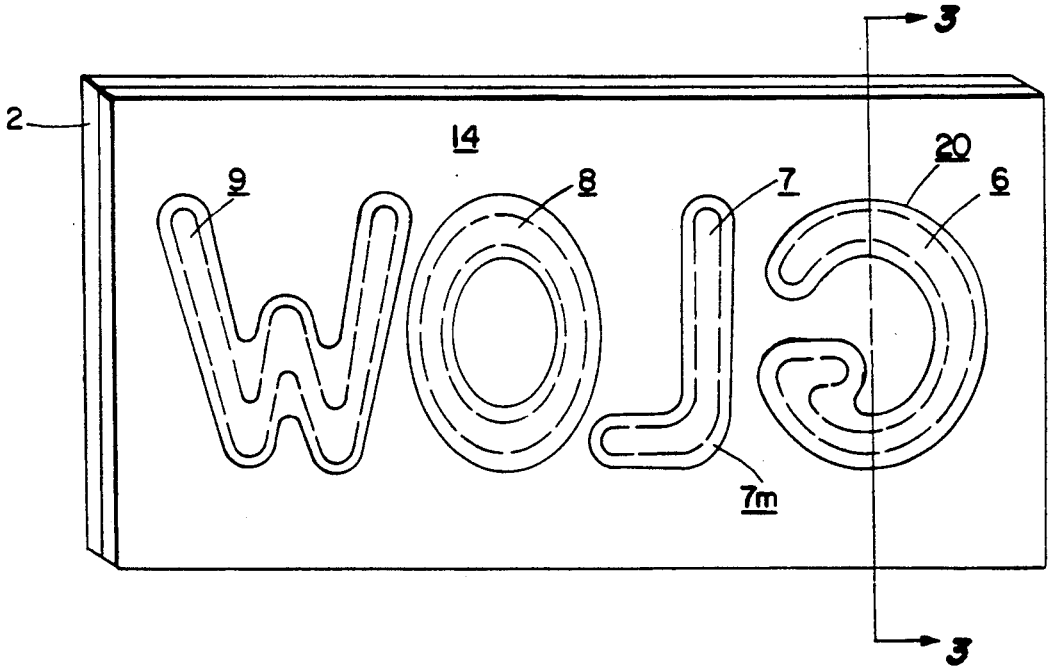
FIG. 2 shows the rear view of the sign panel of FIG. 1.
Figure 5:
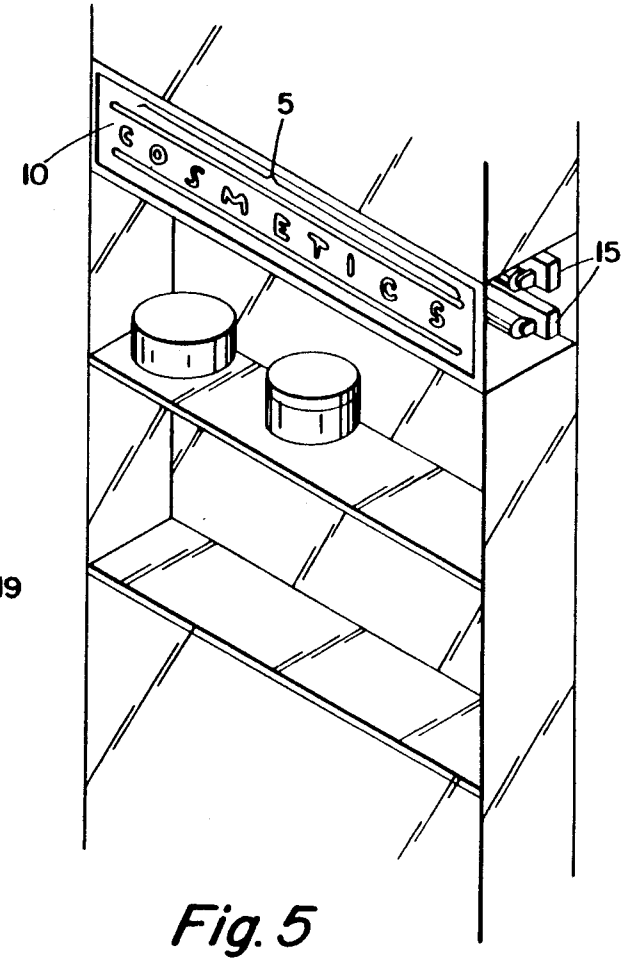
FIG. 5 shows a perspective view of an installed sign panel of the invention in a retail environment.
Figure 3:
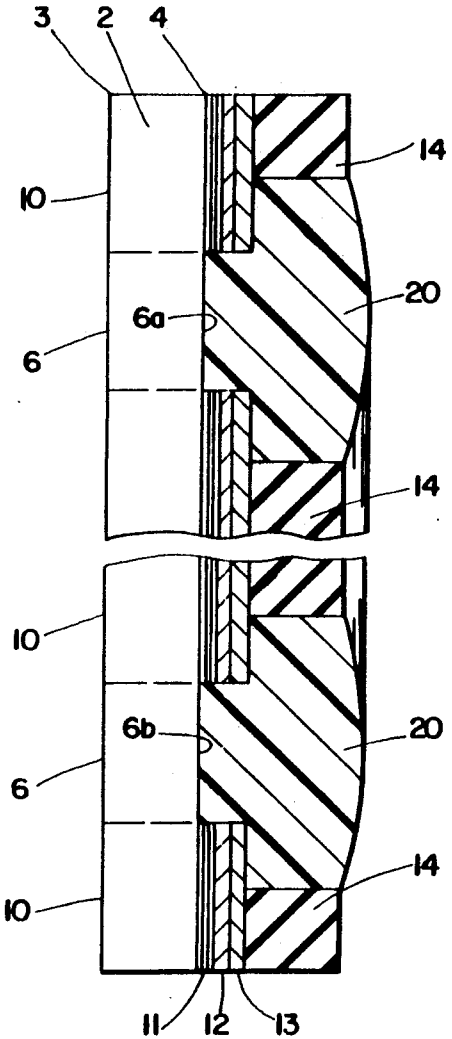
FIG. 3 is a figurative cross-sectional view of the panel of FIG. 2 at section 3→3 showing the various layers of the materials and components which form a light panel of the invention.

FIG. 2 shows the reverse side of the panel of FIG. 1. FIG. 3 is a vertical cross-section through the panel of FIG. 1 at the approximate location of the letter "G" at 6.

The invention provides a sign which produces the visually pleasant effect of a glow radiating from a display image. The sign includes a transparent base panel to which a background color in the form of a pigment, paint or ink is applied on one side of the base panel in a reverse image of the display image, in areas of the panel which do not correspond to the display image. A light reflective layer covers the reverse image in the areas of the panel covered by the reverse image; and a light absorbent layer covers the light reflective layer in the areas of the panel covered by the reverse image. A cast luminescent material, which contrasts with the background color on the panel in the areas of the panel which correspond to the display image, provides the display image on the sign panel which is preferably illuminated by fluorescent backlighting.

With reference to FIG. 3, the clear substrate panel is shown at 2. On the substrate, the design 6 (here, sections of the letter "G") intended to be the sign display is reverse print stenciled, preferably by a silk screen method, on the reverse side of the panel 4, such that the display design remains as a reverse printed clear (i.e. a "negative" of the display expected from the front) section of the panel, as indicated in the cross-section at 6*a* and 6*b*. Thus, an opaque ink or paint layer 11 is provided as the background for the sign display which shows as the contrasting background 10 for the sign display when viewed from the front. The background is of a predetermined color selected for aesthetic or utilitarian impact. Over the reverse print (negative) layer 11, there is stenciled a white, or otherwise light reflective layer 12 in the same area as layer 11. Over the layer 12, a next layer in the same area, being a light absorber such as a black ink or paint 13 is stenciled or otherwise applied.

Preferably the ink or paint layers are based on an epoxy type resin material because the polyester casting material subsequently applied thereover is quite chemically active and/or corrosive and may etch through a layer of lesser durability than epoxy, adversely affecting the appearance of the sign front.

Over the stenciled layers on the substrate, a mat 14 is applied as an overcut cut-out in the area of the design 6. The mat defines the area within which a luminescent casting material 20 is applied and may be cut from an adhesively bondable rubber sheet material.

Thus, there is provided a layered medium for the sign on one side of the base transparent substrate in which a visible background color 11, seen through the panel as the sign front 10 is first applied. A reflecting layer 12, a light absorbing or screening layer 13, and the overcut mat 14 which defines the casting area for a luminescent polymer follow successively.

The luminescent casting material is applied in the cut-out areas of the mat, which correspond to the image of the display design. In brief, the containment mat has a cut-out in correspondence with the display image and is applied to the base after the light absorbent layer is provided, such that the cut-out is aligned with the display image (previously applied as the reverse negative to the panel); and the luminescent material is cast on the panel in the areas of the cut-out of the mat. A suitable luminescent casting material may be one such as described in my above-referenced Letters Patent, essentially as follows:

While many types of fast curing polyester compositions are suitable, a particularly useful polyester is Silmar Polyester Resin S-250 produced by the Silmar Division of Vistron Corporation, 12335 S. Van Ness Avenue, Hawthorne, California 90260 and 3535 Latonia Avenue, Covington, Kentucky 41015. This resin has good color, cures water white, is of medium viscosity and is promoted for room temperature cure. Tables I and II respectively set forth the uncured properties and curing data for the S-250 resin.

TABLE I

| Uncured Properties Liquid Resin at 77° F. | |
|---|---|
| Color | Pal Blue-Green |
| Viscosity, centipoise | 450 |
| Specific Gravity | 1.12 |
| Lbs. per gallon | 9.3 |
| Stability, 77°. (covered) | 3–4 months |
| Stability, 100° F. (uncatalyzed) | 10 days |

TABLE II

| Curing Data Typical Gel Data 77° f. 50 gram casting | |
|---|---|
| Catalyst | Gel time, minutes |
| 0.4% MEK Peroxide | 24.0 |
| 0.8% MEK Peroxide | 13.5 |
| 1.0% MEK Peroxide | 12.0 |

To prepare the casting material, to a measure of 100% by weight of polyester resin there is added 1% MEK Peroxide catalyst and 10% by weight in the same relative proportion of a dry fluorescent, oil-soluble powder, color, dye or pigment which is suitable for fluorescent activation. Such fluorescent pigments capable of being cast in a polymer gel are available from several sources, including Rosco, Iddings Dry Pigments, 36 Busch Avenue, Port Chester, New York 10573, which markets such colorants as a "fluorescent" powder color. These proportions are not critical and may be modified by those experienced in color polymer gel casting. It is noted that the pigment also serves as a filler for the polyester gel. An improvement in stabilizing the longevity of the color fastness of the gel is achieved by the use of a dry fluorescent color with a UV inhibitor in a mixture of UV protected polyester resin. A fluorescent powder color will not dissolve in the gel mixture, but will break up into molecules or other minute particles suspended in the polyester; and each molecule or particle in the mixture will be coated with a layer of UV protected resin.

This resin is so prepared and is then applied as a gel to the cut-out opening in the mat or sheet layer 14 that is applied over the sequentially stenciled areas of the panel. The gel is allowed to cure. Upon curing, the sheet or mat layer 14 need not be removed.

Figure 4:
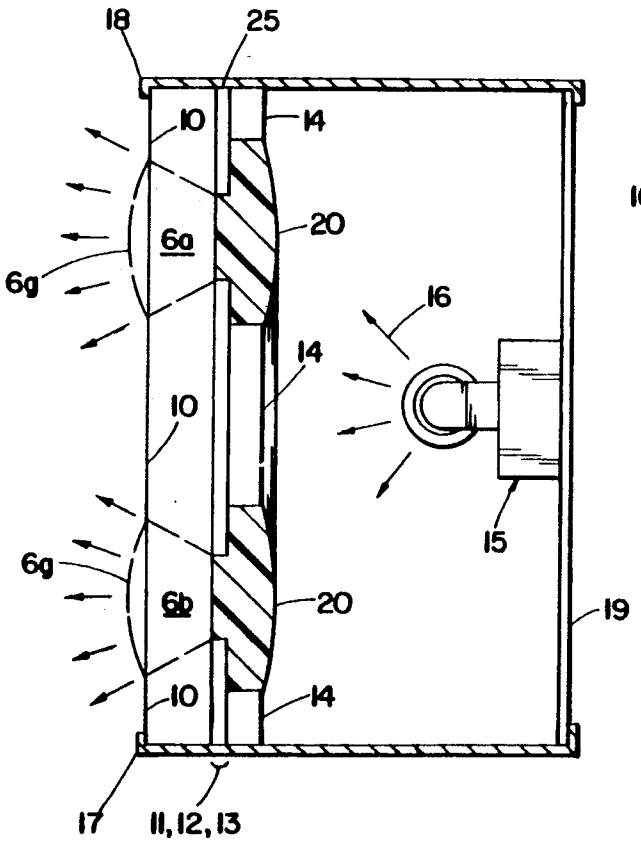
FIG. 4 is another cross-sectional representation in a side view showing the sign panel in conjunction with an illuminating source, and the "glow" effect.

FIG. 4 shows a more realistically proportioned cross-section of the sign in a side view showing panel 2, the display image area 6, the sign background 10 and the luminescent cast polymer 20 in the areas defined by the overcut mat 14. The reverse stenciled ink or paint layers are shown at the interface 25 of the panel 2 and the mat layer 14. The visual appearance of the luminescent area of the glow effect is shown by the lines 6g depicting the visual effect of a bright central image 6 mutely, gradually, or gradiently fading out from the side edges thereof. In FIG. 4, an illuminating lamp, which may be a conventional fluorescent tube lamp is shown at 15 providing back-lighted illumination 16 to the luminescent casting 20. FIG. 4 also shows the configuration of a light box which is suited to the invention. The sign is included in a holding frame with top and bottom sides indicated at 17 and 18 and on the reverse side of the "box" interior the fluorescent lamp 15 is mounted. More than one lamp may be used as the appearance and visibility of the sign is dependent upon ambient light intensity at the sign location. The lamp may be mounted with respect to the top, bottom, center or other location with respect to the sign, and the light box itself may be a permanent fixture in a location, in front of which the sign is appropriately placed.

Signs are made in numerous shapes and sizes for particular displays and applications, thus dimensions of letters, lines and/or designs are determined by the application. In a display application of the invention, a conventional forty-eight (48) inch fluorescent lighting tube provides backlighting in a display for a sign forty-eight (48) inches × ten (10) inches centered in front of the tube at a distance from the surface of the tube of six (6) inches. The panel used as the substrate may be a cast or extruded clear acrylic having a nominal thickness of 0.125 inch and is readily available from numerous manufacturers. A scratch resistant surface is frequently specified for sign panels and is likewise a feature of transparent acrylic panels that is readily available commercially. Although acrylic is a preferred material because of its crystal clarity, other transparent panels such as polycarbonate, glass and co-polymers may be used with suitable adaptations being made so that the luminescent casting gel bonds to the surface.

The containment layer 14 for the casting gel is a cut-out mat of an appropriate thickness. Particularly suitable is an adhesive rubber mat, otherwise intended to be used as a stencil material itself, manufactured as "Continental Stencil," Styles 111, 112 or 123, by Anchor Continental Inc., 2000 S. Beltline Boulevard, Columbia, S.C. 29205. This stencil material has an intrinsic adhesive by which the mat, overcut in size with respect to the reverse stenciled image, may be applied and bonded to the base panel. Other solid mat materials such as matting made from cork, paper and the like may also be used.

In the forty-eight (48) × ten (10) inch sign referred to as an example herein, the width of lettering and design shapes is typically in the range of about one-half (0.5) to one (1.0) inch. The overcut of the mat containment layer with respect to the size of the display image is not critical. The overcut may, however extend approximately 50 to 100% or more from the sharply defined edge of the stencil pattern. FIG. 2 shows the relationship of the mat cut-out to the display design as the mat is applied to the reverse side of the panel. For example, with reference to FIG. 2 if the size of the "L" image 7 were one-half (0.5) inch, the dimension of the overcut mat opening 7 m could be from about one and one-half (1.5) to about two and one-half (2.5) inches. The thickness of the containment mat likewise is not critical and a thickness of 0.0625 inch (1/16") to 0.125 inch (⅛") is suitable to confine within its boundries a luminescent gel (often times assisted by surface tension) in the casting process. Again with reference to FIG. 2, casting gel is applied in the entire cut-out area 7 m shown by the solid line in the figure. Thus, the luminescent material applied to the reverse side of the sign, may extend beyond the side edges of the actual boundries of the stencil design for the display image. The gel in areas may have a thickness of one-eighth (0.125) to one-fourth (0.25) inch.

Signs and displays, of course, come in all shapes, sizes and colors and given the guidelines and examples set forth herein, it should be within the skill of the art to adapt a particular signage application to the method of the invention.

What is claimed is:

1. A method of making a sign which produces the visually pleasant effect of a glow radiating from a display image comprising:

(1) providing a transparent base panel;

(2) providing a background color for the sign by applying the background color to one side of the base panel in a reverse image of the display image in areas of the panel which do not correspond to the display image;

(3) providing a light reflective layer over the reverse image in the areas of the panel covered by the reverse image;

(4) providing a light absorbent layer over the light reflective layer in the areas of the panel covered by the reverse image; and (5) casting a luminescent material which contrasts with the background color on the panel in the areas of the panel which correspond to the display image.

2. The method of claim 1 in which the step of casting includes forming a three dimensional mass from a polyester gel in the areas of the panel.

3. The method of claim 1 or claim 2 in which the step of casting includes providing a gel mass in a ribbon form.

4. The method of claim 1 including the step of mixing a polyester resin with a fluorescent pigment and catalyst to provide a polymeric gel material before the step of casting.

5. The method of claim 1 or claim 2 in which the step of casting includes casting the material in an area on the base panel which extends beyond the side edges of the display image.

6. The method of claim 1 or claim 2 in which in the step of casting: (a) a containment mat having a cut-out in correspondence to the display image is provided on the one side of the panel; (b) the mat is applied to the panel after the light absorbent layer is provided, such that the cut-out is aligned in correspondence with the display image; and (c) the luminescent material is cast on the panel in the areas defined by the cut-out of the mat.

7. The method of claim 6 in which the cut-out of the containment mat extends beyond the side edges of the display image.

8. The method of claim 1 or claim 2 for the display of a sign or design including mounting the panel adjacent to an illuminating lamp.

9. The method of claim 4 in which the step of mounting further includes positioning an illuminating lamp within the volume defined by the sides of a box and positioning the surface of the base panel with the luminescent material applied thereon such that the luminescent material faces the lamp towards the interior of the box and the outer facing surface of the base panel presents a flat surface.

10. The method of claim 2 or claim 4 in which in the step of providing a light absorbent layer an epoxy paint or ink is applied to the areas.

11. The method of claim 1 in which at least one of the background color, the reflective layer and the absorbent layer is provided by a silk screen process.

12. The method of claim 3 for the display of a sign or design including mounting the panel adjacent to an illuminating lamp.

13. The method of claim 3 in which in the step of providing a light absorbent layer an epoxy paint or ink is applied to the areas.

14. A sign or display produced in accordance with the method of claim 1 or claim 2 or claim 4 or claim 9 or claim 11.

15. A sign or display produced in accordance with any one of the methods of claim 3.

16. A sign or display produced in accordance with any one of the methods of claim 5.

17. A sign or display produced in accordance with any one of the methods of claim 6.

18. A sign or display produced in accordance with any one of the methods of claim 7.

19. A sign or display produced in accordance with any one of the methods of claim 8.

20. A sign or display produced in accordance with any one of the methods of claim 10.

21. A sign or display produced in accordance with any one of the methods of claim 12.

22. A sign or display produced in accordance with any one of the methods of claim 13.

* * * * *